United States Patent [19]

Rylicki

[11] Patent Number: 4,701,584

[45] Date of Patent: Oct. 20, 1987

[54] METHOD AND APPARATUS FOR THE INDUCTION HEAT TREATMENT OF IRREGULARLY SHAPED WORKPIECES

[75] Inventor: Edward J. Rylicki, Powell, Ohio

[73] Assignee: Industrial Electric Heating, Inc., Hilliard, Ohio

[21] Appl. No.: 861,280

[22] Filed: May 9, 1986

[51] Int. Cl.[4] ..... H05B 6/10

[52] U.S. Cl. ..... 219/10.57; 219/10.67; 219/10.71; 219/10.43

[58] Field of Search ..... 219/10.57, 10.43, 10.41, 219/10.67, 10.71; 266/129

[56] References Cited

U.S. PATENT DOCUMENTS

| | | | |
|---|---|---|---|
| 3,525,842 | 8/1970 | Steinhoff et al. | 219/10.57 |
| 3,619,540 | 11/1971 | Soworowski | 219/10.71 |
| 3,935,416 | 1/1976 | Cachat | 219/10.57 X |
| 4,119,825 | 10/1978 | Taylor et al. | 219/10.57 X |
| 4,458,125 | 7/1984 | Leis | 219/10.41 |

*Primary Examiner*—Philip H. Leung

*Attorney, Agent, or Firm*—George Wolken, Jr.

[57] ABSTRACT

This invention relates to a method and apparatus for the induction heat treatment of conducting workpieces. More particularly, this invention relates to an apparatus and method for heat treating irregularly shaped workpieces lacking rotational symmetry about a central axis. The heat treatment applied by the apparatus or method of the present invention effects the surface of the workpiece substantially uniformly at all points around the perimeter of a workpiece lacking rotational symmetry, and accomplishing such substantially uniform heat treatment without requiring excessive current flow, without requiring interruptions of large current flow.

8 Claims, 2 Drawing Figures

METHOD AND APPARATUS FOR THE INDUCTION HEAT TREATMENT OF IRREGULARLY SHAPED WORKPIECES

BACKGROUND OF THE INVENTION

This invention relates to a method and apparatus for the induction heat treatment of conducting workpieces, and more particularly to an apparatus and method for heat treating irregularly shaped workpieces lacking rotational symmetry about a central axis, in which such heat treatment effects the surface of the workpiece substantially uniformly at all points around the perimeter of a workpiece lacking rotational symmetry accomplishing such substantially uniform heat treatment with a close-proximity inductor without requiring excessive current flow and without requiring interruptions of current flow and consequent severe wear to contacts.

Heat treating of metals to improve the properties has been in use for many centuries. In particular, it has long been a part of the art of metallurgy and metal working to apply controlled amounts of heat, in a controlled way (such as in a furnace), and often to control the rate of cooling also (such as by means of rapid cooling in water). Such processes are now known to alter the microscopic structure of the metal or alloy being processed in such a way as to cause beneficial properties to be enhanced. The microstructure of the material may be altered by such heat treatment to create a beneficial structure of defects or chemical bonds; minor constituents of the material may be induced to concentrate preferentially in certain regions under careful heat treatment to enhance the properties of those regions (or of the depleted regions); and many other effects well known in the art and science of metallurgy.

The present invention relates to a method and apparatus for the induction heat treatment of conducting workpieces, typically metals or alloys. Typically such heat treatment is performed as a means for case hardening a region of the surface of such workpiece which will be subject to particular wear when the workpiece is put to use in its intended application. It is desired that such hardening be localized to the region or regions which are subject to wear in the intended use. While heat treatment hardens the region of the workpiece against expected wear, it also tends to make the region of heat treatment brittle. Also, heat treatment tends to distort the workpiece from its original shape, thereby increasing the need for later reworking or causing the workpiece no longer to meet the dimensional tolerances required. Thus, it is important for the engineer to tailor the heat treatment process to achieve the optimal balance of wear resistance, strength and dimensional stability for the intended application. Also, since heat treatment requires energy, time and expense, the engineer is likewise motivated to limit such heat treatments to the regions in which it will be needed and to no greater depth than required.

Induction heat treatment makes use of the basic fact of electricity that a time-varying magnetic field induces an electric field (Faraday's Law). When a conductor, such as the workpiece, is placed in an electric field, currents will flow through the conductor in the direction of the electric field in direct proportion to the strength of the electric field and in inverse proportion to the electrical resistance of the conductor (Coulomb's and Ohm's Law). The resistance of the workpiece to current flow will cause the workpiece to heat in the immediate regions of such current, leading to the desired heat treatment effect.

Thus, the basic structure of induction heat treating is to cause an alternating current to flow through a circuit external to the workpiece. This alternating current is brought into close proximity with the surface of the workpiece to be heat treated carried by a conducting element known to the art as the 'inductor'. The flow of alternating current produces an alternating magnetic field in the immediate vicinity of the current (Ampere's Law). The geometry of the alternating current and the workpiece is arranged such that the region of the workpiece to be heat treated is brought into the alternating magnetic field. Thus, heat treating occurs through the mechanism described above.

The depth of the workpiece hardened by such induction heat treating is a function of both the frequency of the alternating current and the power density of current flow induced in the workpiece (with other effects held constant, such as the geometry of the external current flow in the inductor and the workpiece resistivity). Alternating currents with frequencies from approximately 1 kHz to 500 kHz have found application for induction heat treating, with 10 kHz to 50 kHz a more typical range of values. The hardening depth tends to decrease with increasing frequency and with increasing power density (kW/sq. in.) induced in the workpiece.

Induction heat treating has proven itself to be a versatile engineering tool, widely used in many industries to increase the wear resistance of critical components of machinery. While applications in transportation have been dominant, other applications for wear resistance have made use of induction heat treatment as well. Thus, induction heat treatment is a vital and well accepted part of many modern manufacturing processes.

However, there is increasing emphasis on achieving optimum manufacturing efficiency, reducing work-in-process, reducing the need for inventories by just-in-time delivery, and achieving flexible, rapid and reliable throughput at all steps in the manufacturing process. Induction heat treating is one part of the process where such advances can effect both the quality and performance of the final manufactured product, and the efficiency at which it is manufactured.

The present invention describes a method and apparatus for heat treating workpieces having irregular shapes. Such irregular shapes can be induction heat treated in a uniform, economical manner by the invention disclosed herein, without the need for huge currents (as in typical "one-shot" methods), without the need to break the circuit carrying the alternating current during the heat treatment of a workpiece (as in typical "split-inductor" methods) and the resulting high rate of wear to the split-inductor contacts, avoiding the nonuniformities in heat treating irregular parts (such as cams) occurring with the use of circular inductors, and at the same time avoiding the stray heating of adjacent regions.

SUMMARY AND OBJECTS OF INVENTION

The present invention relates to an apparatus and method for induction heat treatment of conducting workpieces having irregular shapes comprising: a single current-carrying inductor split into two parts, (referred to as 'inductors' with the understanding that parts of a single inductor are intended) carrying the induction heating alternating current external to the workpiece and having shapes complimentary to the shape of the workpiece; a means for positioning the inductors in close proximity to the surface of the workpiece in those regions to be heat treated, thereby causing the surface of the workpiece to be in the alternating magnetic fields generated by the alternating current flow through said inductors; a means for translating and reorienting the workpiece with respect to the inductors while maintaining the close proximity required for induction heat treating while avoiding the need to interrupt large flows of current passing through said inductors.

A primary object of the present invention is to provide a method and apparatus for heat treatment of irregularly shaped workpieces such as camshafts without interrupting the alternating current flow through the inductors while the workpiece is being heat treated, thereby substantially reducing the maintenance and wear on contacts when such current flow is interrupted.

Another object of the present invention is to provide a method and apparatus for heat treatment of irregularly shaped workpieces by scanning the conductors along the workpiece while maintaining adequate electrical proximity between the conductors and the workpiece for acceptable heat treatment without excessive current requirements.

Another object of the present invention is to provide a method and apparatus for heat treatment of irregularly shaped workpieces under automated control, substantially without operator intervention.

Another object of the present invention is to provide a method and apparatus for heat treatment of irregularly shaped workpieces which may be programmed for a given shaped part only once and repeatedly utilized.

Another object of the present invention is to provide a method and apparatus for heat treatment of irregularly shaped workpieces with substantially the same cross sectional profile of various orientations.

Another object of the present invention is to provide a method and apparatus for heat treatment of irregularly shaped workpieces with substantially the same cross sectional profile of various orientations by scanning the conductors over the region of heat treatment.

Another object of the present invention is to provide a method and apparatus for heat treatment of irregularly shaped workpieces in a totally circumferential manner, providing thereby substantially uniform heat treatment of the workpiece.

Another object of the present invention is to provide a method and apparatus for heat treating a linear array of irregularly shaped workpieces having various orientations, such as cams on a camshaft, without heat leakage to adjacent parts and without the use of intervening inductors to block such leakage.

DESCRIPTION OF PREFERRED EMBODIMENTS

Figure 1:
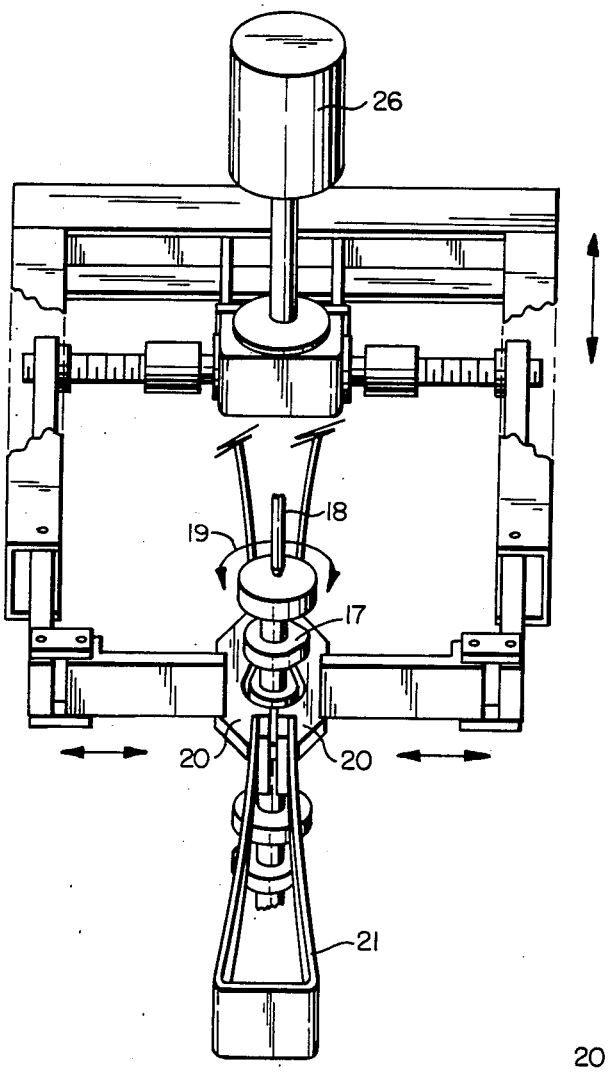
FIG. 1: A perspective view of the apparatus for induction heat treating a typical workpiece having substantially similar cross sectional profile in regions to be heat treated, but various orientations, such as a camshaft as shown here.

FIG. 1 shows in perspective view an apparatus for heat treating a part, typically a camshaft, having the same cross sectional profile requiring heat treatment, but this profile may be oriented in space in various ways.

The workpiece (17) is mounted by means of its central axis (18) into the apparatus, typically by means of spindles. The apparatus is equipped with a means for rotating the workpiece (17) about the central axis (18) as described by rotation (19). Such rotation of the workpiece is typically done under computer control by a fixed amount such that the orientation of the cross sectional profile of workpiece (17) can be brought into a standard orientation with respect to the apparatus and the induction heating conductors (the 'inductors', split into two halves in the present invention) (20). A typical computer controller is denoted by (26) in FIG. 1. Such controllers are standard items in the machine industry and available from several commercial vendors.

Inductor halves (20) are mounted on flexible conducting sheets (21), typically berylliumcopper alloy, and water cooled by means of ducts (22). The conducting sheets (21) are mounted to allow relatively free motion perpendicular to the central axis (18), but in no other direction.

Figure 2:
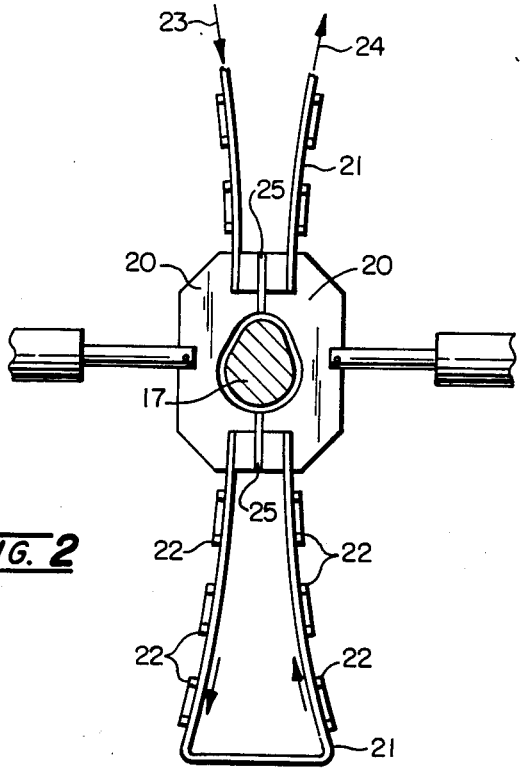
FIG. 2: An elevated, cross sectional view of the apparatus of FIG. 4 through the plane of the induction heat treating conductors.

As shown in FIG. 2, alternating current for heat treating enters at (23) and flows through both inductor halves (20) before exiting at (24) (or the reverse on alternate half-cycles of the alternating current), kept electrically separate, typically by means of suitable insulating material (25). Clearly from FIG. 2, as the inductor halves (20) separate to permit rotation or translation of the workpiece (17) (or passage of the round bearings typically found on camshafts), there is no interruption in current flow. This is in sharp contrast to previous methods using "split-inductors" in which large flows of current are interrupted and restarted, causing marked wear on the contacts through which this occurs.

FIG. 2 illustrates inductor halves (20) as would be used for heat treating a cam, having bilateral symmetry. Thus, the contours of inductor halves (20) have the same shape. That is not necessary in every case. The two halves of the inductor could have quite different shapes for treating workpieces lacking the bilateral symmetry of a typical cam. However, the procedures are obvious modifications of those described herein.

Typically, a workpiece is mounted into the apparatus and the inductor halves (20) moved to the positions requiring heat treating. The axial position and the rotational orientation of the workpiece (17) with respect to the inductor halves (20) are recorded along the length of the workpiece (17) for use by the automatic motion controlling means (26). This programs the motion controlling means (26).

With inductor halves (20) separated, the first region of the workpiece to be heat treated is brought into the plane of inductor halves (20) and oriented such that the profile of the workpiece matches the shape of the inductor halves (20). The inductor halves are brought into close proximity with the surface of the workpiece (typically 0.35 cm or less) with the current flowing to heat treat the workpiece for the desired duration. Without interruption in the current flow, the inductor halves (20) are withdrawn from the workpiece (17), the workpiece is translated and rotated so the second region requiring heat treatment is brought into the plane of inductor halves (20) in the proper orientation. The inductor halves (20) are once again brought into close proximity with the surface of the workpiece with current flowing for heat treatment. The process is repeated as many times as necessary to complete heat treatment of the entire workpiece.

The above technique is described in detail for a camshaft, in which each region to be heat treated can be treated by a single shot with reasonably thin inductor halves (20) without scanning. Clearly, for thick cams in which scanning is required, the workpiece (17) can be translated with respect to the inductor halves (20) without rotation, for the desired length to be heated treated. For piecewise segments (like a camshaft) with large changes in orientation between segments and large diameter bearings in between, the present technique offers a way to produce uniformly heat treated parts via circumferential induced current flows, under continuous computer control, without interrupted current flow and the attendant maintenance problems.

I claim:

1. An apparatus for induction heat treating, by means of a circumferential flow of induced current, an elongate conducting workpiece having substantially the same cross sectional profile in cross section perpendicular to the central elongate axis of said workpiece in regions to be heat treated, comprising; (a) a single inductor carrying alternating current for induction heat treating the surface of said workpiece, said inductor comprised of a first and second half, said inductor halves having shapes complimentary to the shape of the surface of said workpiece substantially conforming to said surface over the area of said surface to be heat treated, said inductor halves positioned on opposing sides of said workpiece having the plane of current flow substantially perpendicular to said elongate axis of said workpiece, wherein the distance of said inductor halves from said workpiece can be varied in a substantially continuous manner, and wherein said first and second inductor halves are electrically connected in series in such a manner that uninterrupted current flow occurs through said first and said second inductor halves as said distance of said inductor halves from said workpiece is varied; (b) a means for accurately positioning said inductor halves in close proximity to said workpiece and in conformity to the shape thereof; (c) a means for translating said workpiece relative to said first and second inductor halves in a direction substantially perpendicular to said plane of current flow while maintaining said close proximity and said conformity of said workpiece and said inductor halves; (d) a means for accurately adjusting the rotational orientation of said workpiece about said elongate axis, in a manner coordinated with said translational position of said workpiece, so as to maintain said conformity and said close proximity of said inductor halves with the surface of said workpiece as said workpiece is translated axially relative to said inductor halves.

2. An apparatus as in claim 1 wherein each of said inductor halves comprises a rigid piece of conducting material, rigidly retaining a shape complimentary to the shape of said workpiece and capable of passing cooling fluid therethrough.

3. An apparatus as in claim 1 wherein said inductor half positioning means comprises; (i) at least one electrically conducting sheet of material rigidly attached to each of said first and second inductor halves, through which sheet said alternating current is capable of passing continuously through said first and second inductor halves, said sheet being rigidly attached to both of said inductor halves permitting relative flexible motion of said inductor halves in directions substantially perpendicular to said elongate axis of said workpiece while rigidly opposing motion of said inductor halves in orthogonal directions; (ii) at least one digitally encoded stepper motor rigidly connected to said inductor halves in such manner as to move said inductor halves in a direction substantially perpendicular to said elongate axis of said workpiece in preencoded positions relative to said workpiece.

4. An apparatus as in claim 3 wherein said electrically conducting sheets comprise flexible alloy of beryllium and copper.

5. An apparatus as in claim 3 wherein said inductor halves are detachable from said electrically conducting sheets and replacable by inductor halves having a different shape for induction heat treating workpieces having varying shapes.

6. An apparatus as in claim 3 wherein said electrically conducting sheets are positioned to provide a large ballast inductance to the circuit carrying induction heat treating current, thereby rendering negligible small variations in said circuit inductance due to variations in said position of said inductor halves.

7. A method for induction heat treating, by means of a circumferential flow of induced current, an elongate conducting workpiece having substantially the same cross sectional profile in cross section perpendicular to the central elongate axis in regions to be heat treated, and having substantially the same spatial orientation of said profile within at least one axial segment along said elongate axis, while having abrupt changes in said spatial orientation between said segments, comprising the steps of; (a) positioning an opposing sides of said workpiece at one end thereof a single inductor carrying alternating current for induction heat treating the surface of said workpiece, said inductor split into a first and second half, said inductor halves having shapes complimentary to the shape of the surface of said workpiece substantially conforming to said surface over the area of said surface to be heat treated, said inductor halves having the plane of current flow substantially perpendicular to said elongate axis of said workpiece; (b) translating said workpiece axially relative to said current-carrying inductor halves the length of the first segment requiring heat treatment and in which segment said cross sectional profile has a substantially fixed orientation, oriented in space complimentary to the shape of said inductor halves; (c) withdrawing said inductor halves from the surface of said workpiece while maintaining uninterrupted current flow through said inductor halves; (d) translating said workpiece axially relative to said inductor halves until an end of a second segment requiring heat treatment is positioned in the current-carrying plane of said inductor halves; (e) rotating said workpiece about said elongate axis such that said cross sectional profile of said workpiece is oriented for a close proximate fit with said complimentary-shaped inductor halves; (f) closing said inductor halves about said workpiece is close proximity thereto; (g) repeating steps (b)–(f) inclusive for each segment to be heat treated.

8. A method for heat treating as in claim 7 wherein said first and second inductor halves have a thickness, in a direction perpendicular to the plane of current flow through said inductor halves, substantially equal to the length of said axial segment of said workpiece requiring heat treatment, thereby omitting translation step (b).

* * * * *